US005222328A

United States Patent [19]

Okumura

[11] Patent Number: 5,222,328

[45] Date of Patent: Jun. 29, 1993

[54] AUTOMATIC OPENING AND CLOSING DEVICE FOR BACK DOOR

[75] Inventor: Junji Okumura, Takahama, Japan

[73] Assignee: Aisin Seiki Kabushiki Kaisha, Kariya, Japan

[21] Appl. No.: 633,491

[22] Filed: Dec. 24, 1990

[30] Foreign Application Priority Data

Dec. 26, 1989 [JP] Japan ..... 1-148749[U]

[51] Int. Cl.[5] ..... E05F 15/04

[52] U.S. Cl. ..... 49/340; 49/344

[58] Field of Search ..... 49/340, 343, 344, 357, 49/280

[56] References Cited

U.S. PATENT DOCUMENTS

| | | | |
|---|---|---|---|
| 2,999,683 | 9/1961 | Pickles . | |
| 3,716,945 | 2/1973 | Cooper et al. . | |
| 4,249,771 | 2/1981 | Gergoe et al. | 49/357 X |
| 4,739,585 | 4/1988 | Pickles . | |
| 4,782,628 | 11/1988 | Gaddis | 49/340 |
| 4,823,059 | 4/1989 | Compeau et al. . | |
| 4,850,094 | 7/1989 | Lybecker | 49/340 X |
| 4,903,435 | 2/1990 | Bittmann et al. . | |
| 4,924,626 | 5/1990 | Ts'ao . | |
| 4,934,203 | 6/1990 | Bailey et al. . | |

FOREIGN PATENT DOCUMENTS

| | | | |
|---|---|---|---|
| 1351096 | 12/1963 | France | 49/340 |
| 63-6927 | 1/1988 | Japan . | |

*Primary Examiner*—Philip C. Kannan
*Attorney, Agent, or Firm*—Finnegan, Henderson, Farabow, Garrett and Dunner

[57] ABSTRACT

An automatic opening and closing device for back door includes a back door rotatably supported on a body. A telescopically adjustable device is telescopically disposed between the back door and the body. One end of the telescopically adjustable device connected to the back door and the other end thereof is connected to the body. A driving device is served for telescopically moving the telescopically adjustable device.

5 Claims, No Drawings

AUTOMATIC OPENING AND CLOSING DEVICE FOR BACK DOOR

BACKGROUND OF THE INVENTION

1. Field of the Invention

This invention relates to an automatic opening and closing device, and more particularly to an automatic opening and closing device for back doors in automobiles.

2. Description of the Related Art

A conventional opening and closing device for a back door is disclosed in Japanese Utility Model Laid Open Publication No. 63(1988)-6927 published without examination on Jan. 1, 1988.

In this conventional opening and closing device for a back door an opening portion is formed in a rear portion of a body in an automobile. A back door is rotatably supported to an upper portion of the opening portion for opening and closing the same. A pair of damper stays are provided on both side portions of the opening portion and are operatively connected to the back door and the portion of the body. A lock mechanism is mounted on the back door and the rear portion of the body, respectively so as to lock the back door to the rear portion of body in closed condition of the opening portion.

The operation of the foregoing device will be explained as follows;

Upon opening of the back door, the lock mechanism is released from the locking position by key operation and then the back door is upwardly lifted by manual power. After the back door is lifted at a certain angle, the back door can be lifted at larger angle because the back door is assisted to be lifted by means of the damper stays. As a result, the back door can be moved to the open condition. Baggages can be picked up from a baggage space through the opening portion communicating with the baggage space. To close the back door, the back door is downwardly pushed by manual power. Thereafter, the back door is assisted to be lowered by the weight thereof against the damper stays. As a result, the back door can be moved to the close condition.

An operator has to open and close the back door from the outside of automobiles because the back door has to be lifted and lowered by manual power. As a result, the back door can not be operated from an interior of automobiles by the operator.

OBJECT AND SUMMARY OF THE PRESENT INVENTION

It is an object of the present invention to provide an automatic opening and closing device for back door in which a back door can be operated from interior of automobiles by the operator.

In order to accomplish the object, the present invention provides a telescopically adjustable pipe which is telescopically disposed between a back door and a body. One end of the telescopically adjustable pipe is connected to the back door and the other end thereof is connected to the body. A motor is provided for telescopically moving the telescopically adjustable pipe.

These and other objects, features and advantages of the present invention will become more apparent on reading the following detailed description.

DETAILED DESCRIPTION OF THE PREFERRED EMBODIMENT

An embodiment of the present invention will hereinafter be described. A back door is rotatably pivoted to a body by a hinge (rotational center of the back door). A baggage space is opened and closed by rotating operation of the back door. A motor is fixed to an inside of the body. A gear is mounted on an output axle of the motor and engaged with a geared cable. First and second brackets are fixed to the body. A guide pipe is disposed between the brackets and opposing ends of the guide pipe are fixed to the respective brackets. The geared cable is slidably inserted in the guide pipe. The distal end of the guide pipe relative to the path of the geared cable from the motor which is fixed to the second bracket is vertically extended through a wall of the second bracket and is fixed to a stopper. A movable means is rotatably pivoted to second bracket by a pin.

A second pipe is fixed to the movable means by a bolt in such manner that one of the second pipe is oriented to oppose the movable means which is held between the one end of second pipe and the bolt. A head portion of bolt is oriented to oppose the stopper. A pair of projections can be formed on the head portion of bolt. The pair of projections is contacted to the stopper so that a rotational angle of the second pipe about the pin is limited.

A hollow tubular rod is slidably disposed in the second pipe. An end of the geared cable is fixed to the hollow tubular rod. A first pipe is fitted to the second pipe and is telescopically movable relative to the second pipe. The first pipe is connected to the hollow tubular rod and rotatably connected to the back door. A spring is disposed between the first pipe and the second pipe. The first pipe is slidably urged against the second pipe by the spring.

Lowermost points of the rotational angle of the first pipe and the second pipe about the pin are set to be the closed condition of the back door. Uppermost points of the rotational angle of the first pipe and the second pipe about the pin are set by a second stopper which is provided on the body.

The operation of the automatic opening and closing device for back door will be explained as follows:

The gear of the motor is rotated in the clockwise direction according to the energizing of the motor. The geared cable is forwardly moved by the engagement between the gear and the geared cable. The hollow tubular rod and first pipe are slided relative to the second pipe. The back door is rotated about the hinge by lifting up the back door in response to a slide of the second pipe and an urging force of the spring. At this time, the first pipe, the second pipe and hollow tubular rod are rotated about the pin through the movable means so as to absorb the off-set generated by the rotation of the back door. Thereby, the back door is opened. Namely, the baggage space becomes accessible from outside the vehicle. The rotation of the back door is stopped in accordance with disenergization of the motor by the contact between the first pipe and the second stopper. When the back door become to the opening condition, the weight of back door acts on the geared cable through the hollow tubular rod. However, the back door is kept at the opening because the urging force of the spring and the engagement between the geared cable and the gear are not overcome by the weight of the back door.

The gear of the motor is rotated in the counter-clockwise direction according to the energizing of the motor. The geared cable is backwardly moved by the engagement between the gear and the geared cable. The hollow tubular rod and the first pipe are slided relative to the second pipe. The back door is rotated about the hinge by lowering the back door against urging force of spring. Thereby, the back door is closed. Namely, the baggage space becomes inaccessible from outside the vehicle. At this time, the urging force of the spring is absorbed by weight of the back door. Therefore, the operating force for closing the back door becomes small.

As above-mentioned, the back door is opened and closed by energizing of the motor. Therefore, the back door can be operated by the operator from the interior of the automobile. As a result, the back door can be easily operated when it is bad weather or operator has a large-sized parcel. Further, the back door is assisted by urging force of spring and is kept at the open condition by engagement between the gear and geared cable and urging force of spring. As a result, the operating force for opening and closing the back door is not influenced by the temperature change because means such as hydraulic actuation is not used in this invention.

The principles, preferred embodiments and modes of operation of the present invention have been described in the foregoing application. The invention which is intended to be protected herein should not, however, be construed as limited to the particular forms disclosed, as these are to be regarded as illustrative rather then restrictive. Variations and changes maybe made by those skilled in the art without departing from the spirit of the present invention. Accordingly, the foregoing detailed description should be considered exemplary in nature and not limited to the scope and spirit of the invention as set forth in the appended claims.

What is claimed is:

1. An automatic opening and closing device for a back door which is rotatably supported by a vehicle-body, the device comprising:

a telescopic mechanism including a first pipe and a second pipe which are telescopically arranged with respect to each other, wherein one end of the first pipe is pivotally connected to the back door, and one end of the second pipe is pivotally connected to the vehicle-body;

a spring disposed within the first pipe and acting between the first pipe and the second pipe;

driving means, operatively connected to the telescopic mechanism, for selectively extending the first pipe relative to the second pipe; and a stopper provided on the vehicle-body for contacting said first pipe after said first and second pipes have pivoted a predetermined amount with respect to the vehicle-body whereby the uppermost limitation of the extension of said first pipe relative to said second pipe is set.

2. The automatic opening and closing device for back door according to claim 1, wherein:

said spring is disposed between said second pipe and said first pipe for urging said first pipe to extend relative to said second pipe.

3. The automatic opening and closing device for back door according to claim 1, wherein said driving means is a motor.

4. The automatic opening and closing device for back door according to claim 3, wherein said first pipe is slidable relative to said second pipe by said motor.

5. The automatic opening and closing device for back door according to claim 4, wherein said motor is connected to said second pipe by a geared cable.

* * * * *